United States Patent [19]

Schneider

[11] Patent Number: 5,000,605

[45] Date of Patent: Mar. 19, 1991

[54] BALL POINT PEN WITH TUBULAR BALL HOLDER

[75] Inventor: Roland Schneider, Tennenbronn, Fed. Rep. of Germany

[73] Assignee: Gebr. Schneider GmbH, Tennenbronn, Fed. Rep. of Germany

[21] Appl. No.: 329,947

[22] Filed: Mar. 29, 1989

[30] Foreign Application Priority Data

Apr. 6, 1988 [DE] Fed. Rep. of Germany ..... 3811530

[51] Int. Cl.[5] ..... B43K 1/08; B43K 7/10

[52] U.S. Cl. ..... 401/209; 401/216

[58] Field of Search ..... 401/199, 212, 216, 214, 401/209, 208

[56] References Cited

U.S. PATENT DOCUMENTS 2,911,949 11/1959 Beckwith ..... 401/212

FOREIGN PATENT DOCUMENTS 1141054 12/1962 Fed. Rep. of Germany ..... 401/216

1252182 12/1959 France ..... 401/216

*Primary Examiner*—Richard J. Johnson

*Attorney, Agent, or Firm*—Peter K. Kontler

[57] ABSTRACT

A ball point pen wherein the ball is held in the front end of a tubular metallic holder. The inner side of the holder is coated with a molded plastic lining which defines a centrally located ink supply channel extending all the way to the ball, one or more axially parallel groove-like capillary channels which communicate with the channel and also extend all the way to the ball, and a seat which is engaged by the confined portion of the peripheral surface of the ball when the pen is in used. The external surface of the holder is partially coated with a jacket which is a snug fit in the front end portion of the housing of the ball point pen and is integrally connected with the lining at one or more points. The lining and the holder, as well as the holder and the jacket, have complementary annular profiles to fix the holder in a desired axial position as soon as the material of the jacket and lining sets. An internal projection of the holder extends into the lining closely behind the seat to transmit forces from the ball to the holder, and an external projection of the jacket abuts the front end face of the housing.

21 Claims, 5 Drawing Sheets

BALL POINT PEN WITH TUBULAR BALL HOLDER

BACKGROUND OF THE INVENTION

The invention relates to writing implements in general, and more particularly to improvements in ball point pens. Still more particularly, the invention relates to improvements in means for holding the ball and in means for supplying ink to the ball in a ball point pen.

German Pat. No. 27 12 058 to Nakagawa et al. discloses a ball point pen wherein the ball is mounted in the front end of a tubular metallic holder and abuts a plastic seat. An advantage of such pen is that the holder is made of wear-resistant metallic material but the ball can roll along a plastic seat and encounters much less resistance than if the seat were made of a metallic material. A drawback of the patented pen is that the cost of making and installing a plastic seat in a tubular metallic holder is relatively high. The seat is produced in a separate step and is thereupon inserted into the holder. This necessitates highly accurate machining of the internal surface of the holder, the making of the seat with a very high degree of precision, and accurate insertion of the seat into the holder. Moreover, care must be exercised to ensure that the prefabricated seat in the prefabricated tubular holder will not interfere with proper flow of ink to the ball. To this end, the properly inserted seat is formed with a centrally located ink supplying passage which terminates at the exterior of the ball in the front end of the holder. When the pen is in use, the front end of the channel is sealed by the ball. It has been found that the making of a channel in the inserted seat contributes significantly to the cost of the writing implement and that such centrally located channel does not always suffice to ensure the delivery of requisite quantities of ink to the working end of the pen. As a rule, the delivery of ink is interrupted when the user is in the process of making long lines on and/or of rapidly moving the ball along a piece of paper or the like.

A similar ball point pen is disclosed in German Pat. No. 887 924 to Schmidt. The patented pen has a metallic tube which carries the ball and is inserted into a plastic support which delivers ink to the interior of the tube behind the ball.

German Utility Model No. 16 87 504 of Petersson discloses a ball point pen wherein a plastic tube is inserted into the metallic ball holder and serves as a seat for the ball as well as to deliver ink to the periphery of the ball.

OBJECTS OF THE INVENTION

An object of the invention is provide a ball point pen wherein the ball is securely mounted in its holder and can roll in the holder with little friction while receiving adequate quantities of ink regardless of whether the pen is used to draw long or short lines and/or whether it is moved rapidly or slowly along the surface which is to be provided with indicia.

Another object of the invention is to provide a novel and improved combination of ball holder and ball seat for use in ball point pens.

A further object of the invention is provide a ball point pen wherein the ball holder, the seat for the ball and the means for supplying ink to the ball can be produced and assembled at a small fraction of the cost of making and assembling such parts in accordance with heretofore known proposals.

An additional object of the invention is to provide a novel and improved method of making ink supplying means for use in ball point pens.

Still another object of the invention is to provide a ball point pen wherein the ball is properly held, seated and supplied with ink even though the ink supplying means and the seat for the ball need not be made and/or finished in material removing machines.

A further object of the invention is to provide a novel and improved combination of ink supplying means and ball seating means for use in the above outlined ball point pen.

Another object of the invention is to provide a novel and improved method of making and installing ink supplying means in the housing of a ball point pen.

An additional object of the invention is provide a novel and improved combination of tubular housing and ink supplying means for use in a ball point pen.

A further object of the invention is to provide a novel and improved method of ensuring predictable and continuous flow of ink to the ball of a ball point pen.

Another object of the invention is to provide novel and improved means for coupling the ball holder of the above outlined pen with the ink supplying means.

A further object of the invention is to provide a novel and improved combination of ball, ball holder and ink supplying means for use in a ball point pen.

SUMMARY OF THE INVENTION

The invention is embodied in a ball point pen which comprises a tubular holder, a ball which is rotatably mounted in the front end of the holder, and means for supplying ink to the ball. The ink supplying means includes a plastic lining which is molded into and overlies at least a portion of the internal surface of the holder and has at least one capillary ink conveying passage extending at least close to the ball. The holder preferably contains or consists of a metallic material, and the pen further comprises a seat or back support for the ball in the front end of the holder.

The lining further defines an ink supplying channel which extends to the ball and communicates with the capillary passage or passages. Each passage can constitute an elongated groove which extends substantially axially and radially of the holder and has an open end at the seat adjacent the ball. The inner diameter of that portion of the holder which is adjacent the front end preferably equals or approximates the diameter of the ball. The seat can constitute an integral part of the lining and is surrounded by the aforementioned portion of the holder.

In accordance with a presently preferred embodiment, the lining has an annulus of substantially equidistant capillary passages each of which communicates with the ink supplying channel. The latter is disposed centrally of the lining and is surrounded by the annulus of passages.

The ink supplying means preferably further comprises a jacket which is molded around and surrounds at least a portion of the external surface of the holder, and means for integrally connecting the lining with the jacket. The connecting means preferably includes a portion which is adjacent the rear end of the holder, i.e., the rear end can be confined between the lining, the jacket and such portion of the connecting means. The jacket and the holder can comprise complementary profiled means for form-lockingly securing the holder to the ink supplying means. Analogously, profiled means for formlockingly securing the holder to the ink supplying means can be provided between the holder and the lining. The connecting means can further include one or more portions extending through one or more openings (e.g., substantially radially extending holes, bores, cutouts, notches or slots) of the holder and being integral with the lining and with the jacket of the ink supplying means.

A housing of the pen at least partially surrounds the jacket of the ink supplying means. The internal surface of the front end portion of such housing is preferably complementary to and receives the external surface of a portion of or the entire jacket. An external projection (e.g., a circumferentially complete flange) of the jacket preferably abuts the front end face of front portion of the housing.

The holder can be provided with at least one internal projection which is at least partially embedded in the lining. Such projection can include an undercut portion of internal surface of the holder. For example, the internal projection can include or constitute a circumferentially complete internal collar of the holder. Such internal projection is spaced apart from the seat in the axial direction of the holder a distance which equals $\frac{1}{3}$ to $1\text{-}\frac{1}{2}$ d (d is the diameter of the ball). This distance preferably equals or approximates the radius of the ball. The internal projection preferably extends all the way to the deepmost portion of each capillary passage in the lining.

The novel features which are considered as characteristic of the invention are set forth in particular in the appended claims. The improved ball point pen itself, however, both as to its construction and the mode of making and assembling the same, together with additional features and advantages thereof, will be best understood upon perusal of the following detailed description of certain specific embodiments with reference to the accompanying drawing.

DESCRIPTION OF PREFERRED EMBODIMENTS

Figure 1:
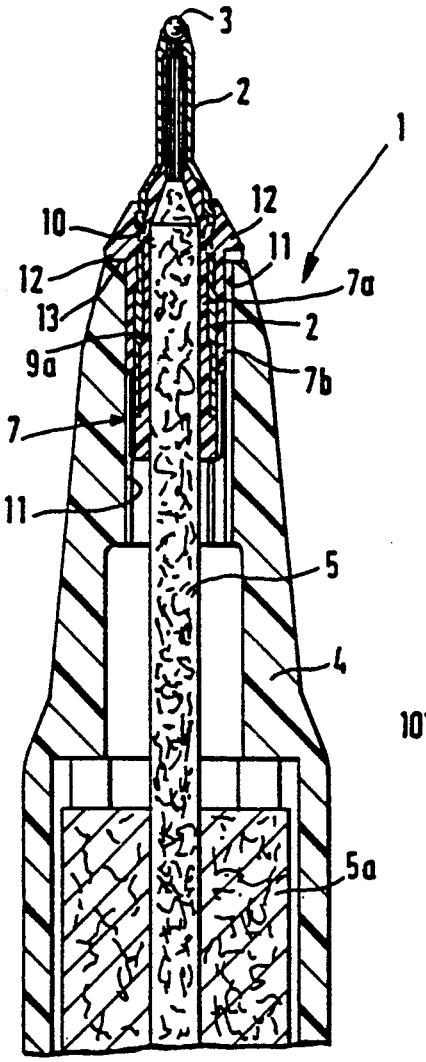
FIG. 1 is a fragmentary central longitudinal sectional view of a ball point pen which embodies the invention.

The reference character 1 denotes the working end of a ball point pen which includes a tubular housing 4, an ink supplying device 7 which is inserted into the front end portion of the housing 4, a tubular ball holder 2 which is embedded between a lining *7a* and a jacket *7b* of the ink supplying device 7, a ball 3 which is mounted in the front end of the holder 2, and a wick 5 which supplies ink from a source *5a* in the interior of the housing.

Figure 2:
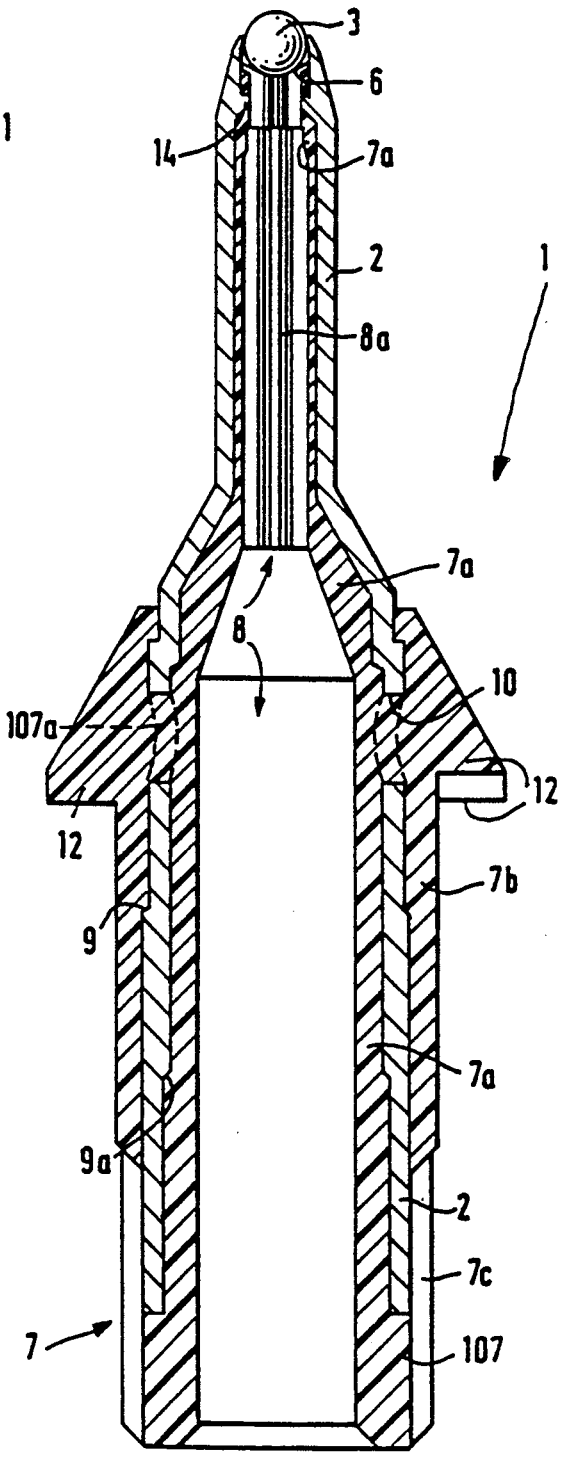
FIG. 2 is an enlarged view of the ball, of the ball holder and of the ink supplying means in the ball point pen of FIG. 1.
Figure 3:
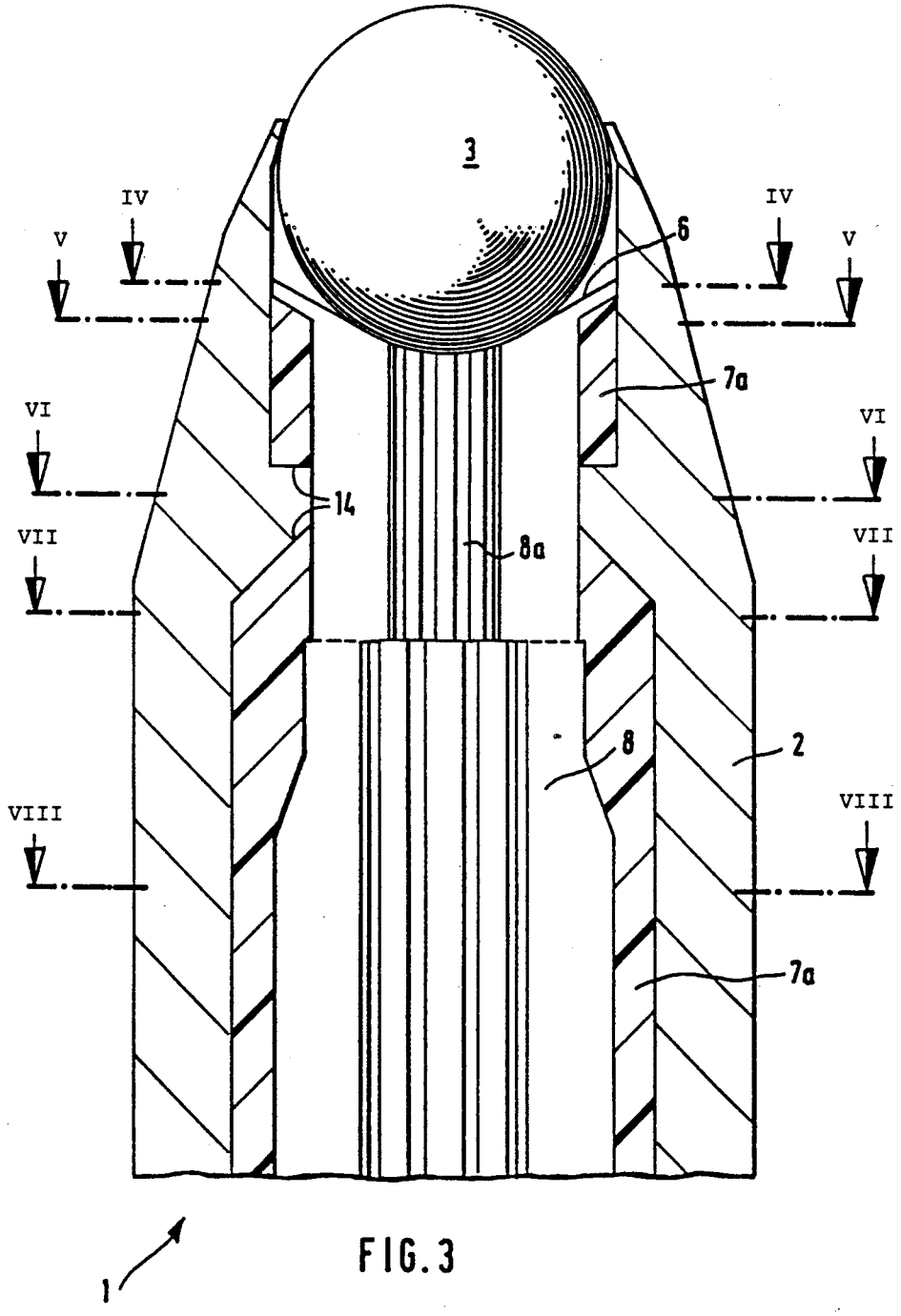
FIG. 3 is an enlarged view of the structure which is shown in the upper part of FIG. 2.
Figure 4:
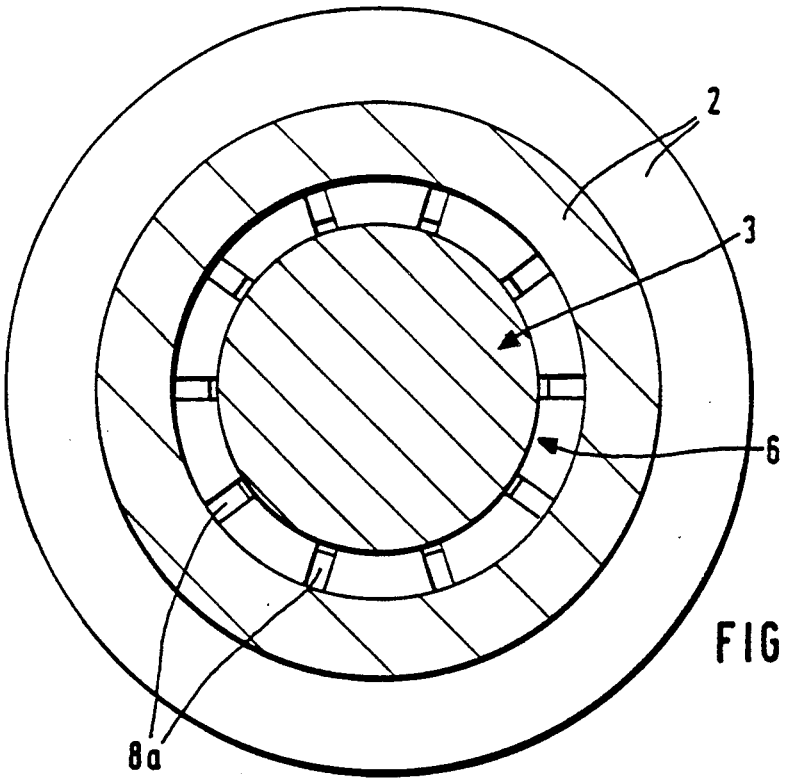
FIG. 4 is a transverse sectional view as seen in the direction of arrows from the line IV—IV of FIG. 3.
Figure 5:
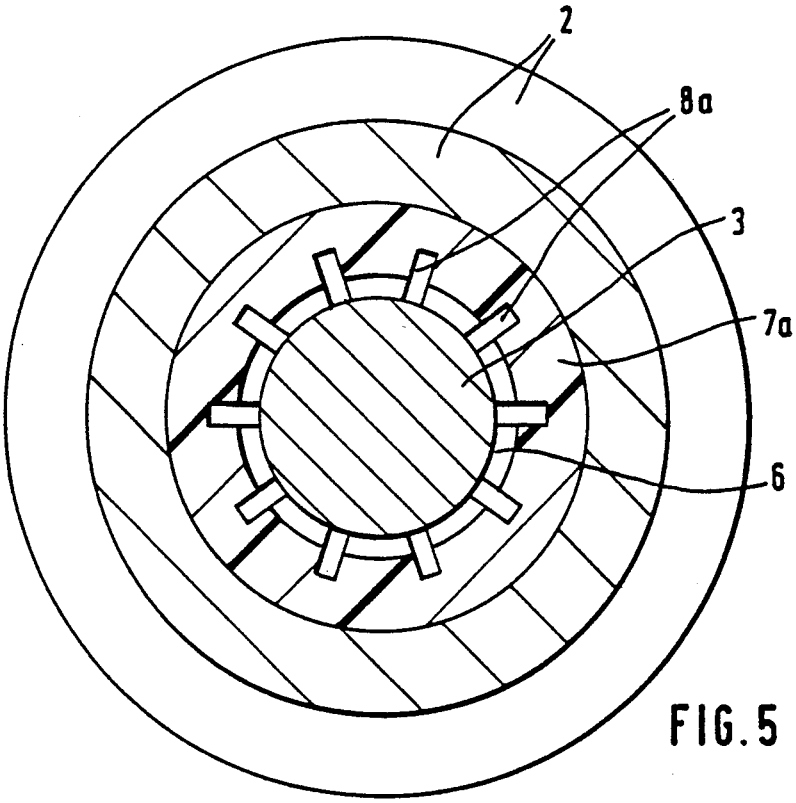
FIG. 5 is a transverse sectional view as seen in the direction of arrows from the line V—V of FIG. 3.

The holder 2 is a relatively short metallic tube. The manner in which the ball 3 is held in the front end of the holder 2 is shown in FIG. 3. FIGS. 1 and 2 show that the diameter of the front section of the holder 2 (namely of the section the front end of which receives the ball 3) is smaller than the diameter of the rear section (this rear section extends into the front end portion of the housing 4 when the latter receives the jacket *7b* of the ink supplying device 7). The inner diameter of the rear section of the holder 2 suffices to receive a relatively thick rear section of the lining *7a* as well as the front portion of the wick 5.

The front section of the holder 2 confines an annular seat 6 for the adjacent portion of the ball 3. This seat is an integral part of the lining *7a*. The entire ink supplying device 7 is an injection molded part which is formed around the holder 2 in a suitable machine with a degree of accuracy such that it does not require any secondary (material removing) treatment.

Figure 6:
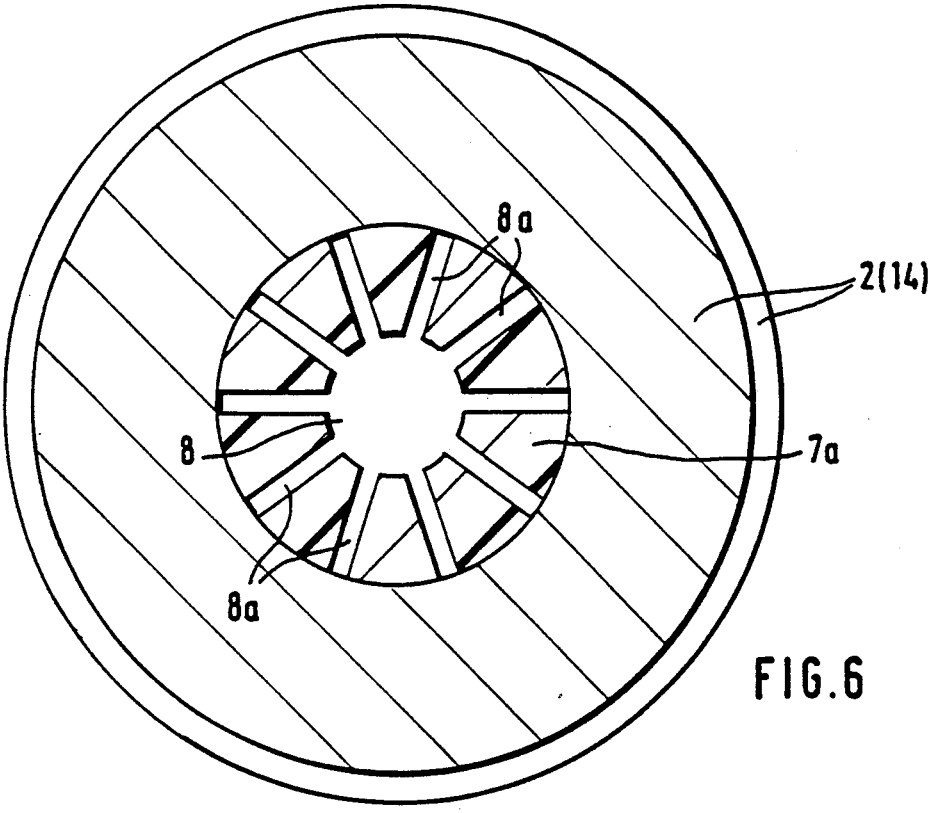
FIG. 6 is a transverse sectional view as seen in the direction of arrows from the line VI—VI of FIG. 3.
Figure 7:
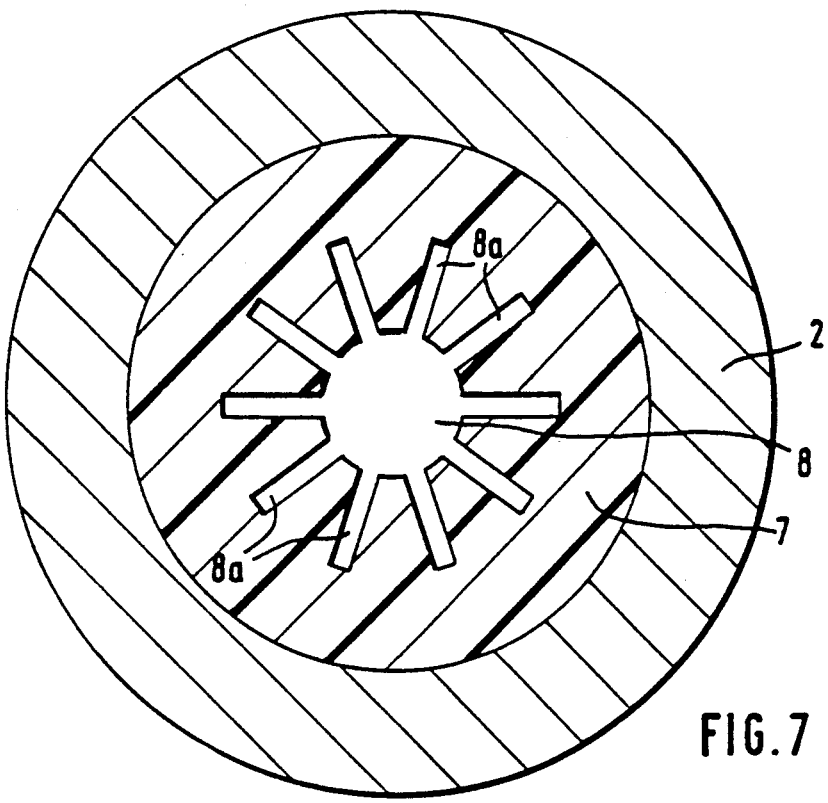
FIG. 7 is a transverse sectional view as seen in the direction of arrows from the line VII—VII of FIG. 3.
Figure 8:
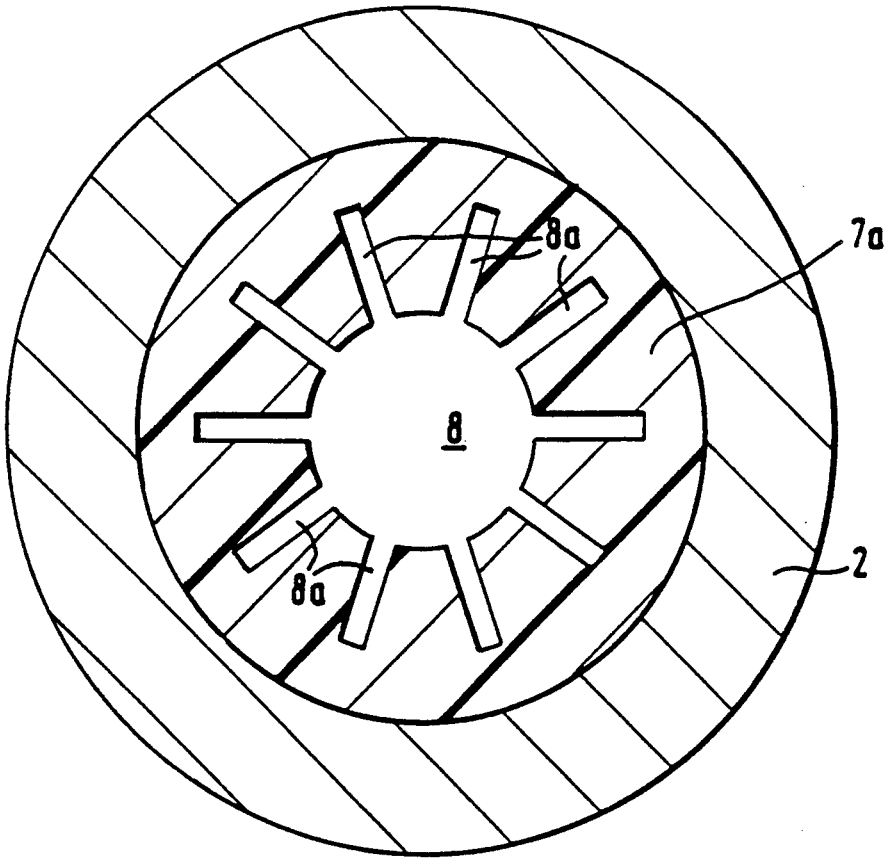
FIG. 8 is a transverse sectional view as seen in the direction of arrows from the line VIII—VIII of FIG. 3.

The lining *7a* defines a centrally located ink supplying channel 8 which has a preferably circular cross-sectional outline (note FIGS. 6, 7 and 8) and communicates with an annulus of axially parallel capillary passages *8a* in the form of grooves provided in the internal surface of the lining *7a* and extending in parallelism with the axis of the holder 2 as well as radially outwardly from the axis of the channel 8 toward and all the way to the internal surface of the holder 2 (FIG. 6). The wick 5 extends into the channel 8. The open front ends of the passages *8a* extend into the seat 6 and are immediately adjacent the peripheral surface of the ball 3.

The inner diameter of that portion of the holder 2 which surrounds the seat 6 equals or closely approximates the diameter of the ball 3. The inwardly bent front end of the holder 2 contacts the ball 3 when the pen is not in use to thus ensure that the ball cannot leave its holder. However, when the pen is in use and the exposed portion of the peripheral surface of the ball 3 bears against a piece of paper or the like, the confined portion of the peripheral surface of the ball bears against the seat 6 so that friction between the ball and the holder is negligible or nil, i.e., the ball 3 rolls along the substantially frustoconical front side of the seat 6 which is made of a plastic material. This greatly reduces the resistance which the ball 3 encounters to rolling movement in actual use of the pen.

Another advantage of the above described mounting of the ball 3 in the holder 2 in front of the seat 6 is that the pen can employ a large-diameter ball and a relatively small-diameter holder 2 in spite of the fact that the entire (or practically entire) internal surface of the holder is coated with a molded lining *7a* of plastic material.

The capillary passages *8a* are preferably equidistant from each other in the circumferential direction of the holder 2. This ensures that the peripheral surface of the ball 3 receives a requisite quantity of ink irrespective of the direction of rolling movement of the ball in actual use of the pen. It has been found that such capillary passages ensure satisfactory delivery of ink even if the pen is used while the holder 2 is horizontal or while the ball is located at a level above the seat 6.

The lining *7a* covers the major part of the internal surface of the holder 2, whereas the jacket *7b* surrounds at least the major part of the larger-diameter rear section of the holder. The jacket 7*b* ends in the region of transition from the larger-diameter rear section into the smaller-diameter front section of the holder 2. While it is within the purview of the invention to provide a two-piece ink supplying device wherein the jacket is not integrally connected with the lining, it is presently preferred to provide the ink supplying device with means for integrally connecting the jacket with the lining. As can be seen in FIG. 2, the connecting means includes a portion 107 which is integral with the rearmost portion of the lining 7*a* and with the adjacent portion of the jacket 7*b*. The jacket 7*b* has external ribs 7*c* which are confined in the front end portion of the housing 4 when the ball point pen is assembled. The connecting means further comprises a portion 107*a* which extends through a radial opening 10 of the holder 2 and is integral with the adjacent portions of the lining 7*a* and jacket 7*b*. This even more reliably ensures that the holder 2 is maintained in a predetermined optimum position with reference to the ink supplying device 7. The connecting portion 107*a* can be provided in addition to or in lieu of the connecting portion 107. The holder 2 can have two or more suitably distributed circular openings 10 (or otherwise configurated openings) for an equal number of connecting portions 107*a*.

In order to even further reduce the likelihood of axial migration of the ink supplying device 7 relative to the holder 2 and/or vice versa, the holder 2 has an internal profile 9*a* which cooperates with a complementary external profile of the lining 7*a* to prevent the holder 2 from moving relative to the lining in a downward direction (as seen in FIG. 2) or vice versa. It is further desirable to provide the holder 2 with an external profile 9 which cooperates with a complementary internal profile of the jacket 7*b* to prevent the jacket from moving relative to the holder 2 in a downward direction (as seen in FIG. 2) and vice versa. The profiles 9 and 9*a* establish form-locking connections which prevent axial movements of the holder 2 relative to the ink supplying device 7 in both axial directions. Such profiles are preferably undercut portions of the respective surfaces of the holder 2, lining 7*a* and jacket 7*b*. The form-locking profiles 9 and 9*a* cooperate with each other and with the connecting portion 107 to locate the holder 2 in the axial direction of the ink supplying device 7, and the connecting portion 107*a* prevents angular movements of the holder 2 and ink supplying device 7 relative to each other. This ensures reliable retention of the ball 3 in an optimum position, proper adherence of the ink supplying device 7 and holder 2 to each other, and long useful life of the pen even if the housing 4 confines a large ink cartridge.

The jacket 7*b* of the ink supplying device 7 fits snugly into the internal surface 11 of the front end portion of the housing 4. As mentioned above, the jacket 7*b* is provided with axially parallel external grooves or flutes 7*c* which receive complementary internal ribs of the housing 4. The jacket 7*b* is further provided with an external projection 12 in the form of a circumferentially complete flange abutting the front end face 13 of front end portion of the housing 4 to limit the extent of penetration of the jacket into the space within the confines of the internal surface 11.

As can be seen in FIGS. 2, 3 and 6, the holder 2 has an internal projection 14 in the form of a circumferentially complete collar which extends radially inwardly all the way to the deepmost (radially outermost) portions of capillary passages 8*a* in the lining 7*a*. The projection 14 is flanked by the material of the lining 7*a* at each of its axial ends so that it also contributes to prevention of axial movement of the holder 2 and ink supplying device 7 relative to each other. Moreover, such projection prevents excessive shrinkage of the lining 7*a* during setting of plastic material of which the lining is made. The distance of the projection 14 from the seat 6 and ball 3 is preferably between $\frac{1}{3}$ and $1\text{-}\frac{1}{2}$ d wherein d is the diameter of the ball 3. A presently preferred distance equals or approximates the radius of the ball 3. The purpose of the projection 14 is to transmit forces from the seat 6 to the holder 2 when the pen is in use and the ball 3 bears against the conical front side of the seat 6. Moreover, and as already mentioned above, the projection 14 prevents excessive shrinkage of the material of the lining 7*a* between the front end of the holder 2 and the projection 14 to thus ensure that the front end face of the seat 6 is located in an optimum position with reference to the ball 3 when the material of the lining 7*a* has set and the ball is properly installed in the front end of the holder 2.

The feature that the projection 14 extends all the way to the radially outermost portions of the capillary passages 8*a* ensures that the projection 14 can effectively limit the extent of shrinkage of plastic material of the lining 7*a* rearwardly of the seat 6. Such internal projection cannot interfere with the flow of ink along the capillary passages 8*a* all the way to the peripheral surface of the ball 3.

An important advantage of the improved ball point pen is that the holder 2 can be provided with an internal lining (at least in a region immediately or closely behind the ball 3), with an external jacket, and with a plastic seat for the ball in a single operation. This greatly reduces the initial and assembly cost of the writing implement. Moreover, such coating of the holder 2 with an internal liner takes place simultaneously with the making of one or more capillary passages which enhance the flow of ink toward the ball 3 in practically all positions of the pen. It is no longer necessary to make the seat and the ink supplying channel in separate operations in a material removing machine, and the seat 6 is invariably maintained in an optimum position with reference to the confined portion of the peripheral surface of the ball 3 because the internal projection 14 prevents excessive shrinkage of plastic material in the region immediately behind the ball. The maker of the pen need not be concerned with tolerances because the molding operation, which is resorted to for the making of the ink supplying device 7, invariably ensures satisfactory dimensioning of the seat 6, of the channel 8, of the passage or passages 8*a* and of all other parts of the device 7. Still further, each of a short or long series of ball point pens embodying the features of the present invention has an ink supplying device 7 the dimensions of which invariably match the dimensions of an ideal ink supplying device. The radially outwardly extending passages 8*a* ensure predictable flow of a highly viscous or a readily flowable ink irrespective of orientation of the housing 4.

The jacket 7*b* constitutes an optional but highly desirable and advantageous feature of the improved ink supplying device 7. This jacket cooperates with the lining 7*a* to maintain the holder 2 and the ball 3 in an optimum position with reference to the ink supplying device 7. Furthermore the jacket 7*b* ensures that the lining 7*a* cannot shift its seat 6 with reference to the holder 2, and such task of the jacket 7*b* is assisted by the internal projection 14 of the holder 2. The external surface of the jacket 7*b* is configurated in such a way that it fits snugly into the space within the internal surface 11 of the housing 4; this renders it unnecessary to subject the housing 4 and/or the ink supplying device 7 to any secondary treatment for the purpose of properly retaining the device 7 in the housing. The external projection 12 of the jacket 7*b* ensures that the ink supplying device 7 is maintained in an optimum axial position with reference to the housing 4. As shown in the drawing, the projection 12 can constitute the foremost portion of the jacket 7*b*. In the embodiment which is shown in FIGS. 1 to 8, the entire external surface of the smaller-diameter front section of the holder 2 remains exposed when the pen is assembled, i.e., when the jacket 7*b* extends into the housing 4 and the projection 12 abuts the front end face 13.

As mentioned above, the internal projection 14 prevents excessive shrinkaqe of the lining 7*a* during setting of plastic material of which the ink supplying device 7 is made. The relatively small shrinkage of such material in the axial direction of the holder 2 between the front end of the holder and the projection 14 can be calculated in advance to thus ensure that the seat 6 is in an optimum position to serve as a back support for the ball 3 when the pen is in use and the ball rolls in the front end of the holder 2. In other words, shrinkage of the material of the lining 7*a* is broken up into relatively small shrinkage of plastic material between the front end of the holder 2 and the projection 14, and additional shrinkage between the projection 14 and the rear end of the holder. While it is possible to provide one or more discrete internal projections in the form of studs or analogous inwardly extending protuberances, it is preferred to provide the holder 2 with an annular protuberance 14 because such protuberance is more likely to uniformly reduce shrinkage (if any) of plastic material behind the front end of the holder, and such annular internal projection is also more likely to uniformly divide the forces which are transmitted to the holder 2 in actual use of the ball point pen.

A modern injection molding or like plastic forming machine is sufficiently accurate to ensure the formation of a lining 7*a* and a jacket 7*b* with a degree of precision which renders it unnecessary to subject the combination of holder 2 and ink supplying device 7 to any secondary treatment prior to assembly of the ball point pen. As a rule, the ball must be installed in the holder with a degree of precision such as to reduce the acceptable tolerances to a few hundredths of a millimeter.

The construction of other parts of the improved writing implement including the rear portion of the housing 4, the manner of charging the housing with ink and the manner of providing the housing with a clip or the like forms no part of the present invention. Reference may be had to writing implements which are manufactured and distributed by the assignee of the present application.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A ball point pen comprising a tubular metallic holder having a front end, a rear end, an external surface and an internal surface; a ball mounted in the front end of said holder; and means for supplying ink to said ball, including a plastic lining molded into and overlying a major portion of said internal surface and having an ink supplying channel extending to said ball and at least one capillary ink conveying passage communicating with said channel and extending at least close to said ball, a plastic jacket surrounding at least a portion of said external surface and forming an extending shoulder, and passage means in said holder interconnecting said lining with said jacket.

2. The pen of claim 1, wherein said holder contains a metallic material and further comprising a seat for said ball.

3. The pen of claim 1, wherein said lining overlies at least a major portion of said internal surface.

4. The pen of claim 1, wherein said passage is an elongated groove extending substantially radially of said holder and having an open end at said seat adjacent said ball.

5. The pen of claim 1, wherein said holder includes a portion adjacent said front end and having an inner diameter at least approximating the diameter of said ball.

6. The pen of claim 2, wherein said seat is an integral part of said lining and said portion of said holder surrounds said seat.

7. The pen of claim 1, wherein said lining has an annulus of substantially equidistant passages each communicating with said channel.

8. The pen of claim 1, wherein said connecting means includes a portion which is adjacent the rear end of said holder.

9. The pen of claim 1, wherein said jacket and said holder include profiled means for form-lockingly securing said holder to said ink supplying means.

10. The pen of claim 1, wherein said holder and said lining comprise profiled means for formlockingly securing said holder to said ink supplying means.

11. The pen of claim 1, wherein said holder has at least one opening and said connecting means comprises a portion extending through said opening and integrally connecting said lining with said jacket.

12. The pen of claim 11, wherein said opening is a radially extending hole in said holder.

13. The pen of claim 1, further comprising a pen housing having a front end portion receiving at least a portion of said jacket.

14. The pen of claim 13, wherein said front end portion has an internal surface and said jacket has an external surface complementary to and fitted into said internal surface.

15. The pen of claim 13, wherein said jacket has an external projection and the front end portion of said housing has a front end face abutting said projection.

16. The pen of claim 1, wherein said holder has at least one internal projection which is at least partially embedded in said lining.

17. The pen of claim 16, wherein said projection includes an undercut portion of said internal surface.

18. The pen of claim 16, wherein said projection includes a circumferentially complete internal collar of said holder.

19. The pen of claim 16, further comprising a seat for said ball, said projection being spaced apart from said seat in the axial direction of said holder a distance equal $\frac{1}{3}$ to $1\text{-}\frac{1}{2}$ d wherein d is the diameter of said ball.

20. The pen of claim 19, wherein said projection includes a ring-shaped internal collar and d equals or approximates the radius of said ball.

21. The pen of claim 16, wherein said passage has a deepmost portion which is remotest from the axis of said holder and said projection extends radially inwardly from said internal surface to the deepmost portion of said passage.

* * * * *